US005318360A

United States Patent [19]

Langer et al.

[11] Patent Number: 5,318,360

[45] Date of Patent: Jun. 7, 1994

[54] GAS DISPERSION STIRRER WITH FLOW-INDUCING BLADES

[75] Inventors: Gert Langer, Fröndenberg; Udo Werner, Rechlinghausen, both of Fed. Rep. of Germany

[73] Assignee: Stelzer Ruhrtechnik GmbH, Warburg, Fed. Rep. of Germany

[21] Appl. No.: 892,089

[22] Filed: Jun. 2, 1992

[30] Foreign Application Priority Data

Jun. 3, 1991 [DE] Fed. Rep. of Germany ... 9106768[U]

[51] Int. Cl.[5] ..... B01F 7/26

[52] U.S. Cl. ..... 366/317; 366/316; 261/87; 416/181; 416/231 A

[58] Field of Search ..... 366/102-104, 366/107, 164, 315-317, 343; 261/87; 416/181, 185, 231 A

[56] References Cited

U.S. PATENT DOCUMENTS

| | | | |
|---|---|---|---|
| 573,473 | 12/1896 | Millard | 366/317 X |
| 720,513 | 2/1903 | Cheney | 366/317 X |
| 1,084,210 | 1/1914 | Howard | 366/317 X |
| 1,093,751 | 4/1914 | Wheeler | 366/316 |
| 1,374,446 | 4/1921 | Greenawalt | 261/87 |
| 1,413,724 | 4/1922 | Groch | 261/87 |
| 1,417,883 | 5/1922 | Beers | 261/87 X |
| 1,853,067 | 4/1932 | Martin | 366/102 |
| 1,925,777 | 9/1933 | Sperling | 261/87 |
| 2,031,590 | 2/1936 | Daman | 366/102 X |
| 2,288,063 | 6/1942 | Ashlock, Jr. | 366/164 X |
| 3,650,513 | 3/1972 | Werner | 261/87 |
| 3,782,702 | 1/1974 | King | 261/87 |
| 3,814,396 | 6/1974 | Di Gregorio et al. | 261/87 X |
| 3,917,763 | 11/1975 | Schafer | 261/87 |
| 3,984,001 | 10/1976 | Nagano et al. | 366/103 X |

FOREIGN PATENT DOCUMENTS

| | | | |
|---|---|---|---|
| 0364678 | 4/1990 | European Pat. Off. . | |
| 900087 | 11/1953 | Fed. Rep. of Germany . | |
| 1083771 | 6/1960 | Fed. Rep. of Germany . | |
| 1189952 | 4/1965 | Fed. Rep. of Germany | 261/87 |
| 1244121 | 7/1967 | Fed. Rep. of Germany . | |
| 2006313 | 3/1971 | Fed. Rep. of Germany | 261/87 |
| 2005593 | 7/1971 | Fed. Rep. of Germany . | |
| 2544204 | 4/1977 | Fed. Rep. of Germany . | |
| 1093699 | 5/1955 | France | 261/87 |
| 1158406 | 6/1958 | France | 261/87 |
| 832526 | 4/1960 | United Kingdom | 366/164 |
| 1206074 | 9/1970 | United Kingdom | 366/102 |
| 2004195A | 3/1979 | United Kingdom . | |
| 1567451 | 5/1980 | United Kingdom . | |

*Primary Examiner*—Harvey C. Hornsby
*Assistant Examiner*—Charles Cooley
*Attorney, Agent, or Firm*—Morgan & Finnegan

[57] ABSTRACT

A gas dispersion stirrer comprises a rotatable hollow shaft and at least one circular hollow stirring member disposed thereon wherein the cavity in the stirring member communicates with the hollow shaft. The stirring member has aeration apertures disposed in an outer peripheral portion thereof. The stirring member has flow-inducing blades for radially directing the liquid from the hollow shaft toward the aeration apertures. The gas dispersion stirrer effectively aerates liquids and achieves an improvement in mass transfer.

16 Claims, 2 Drawing Sheets

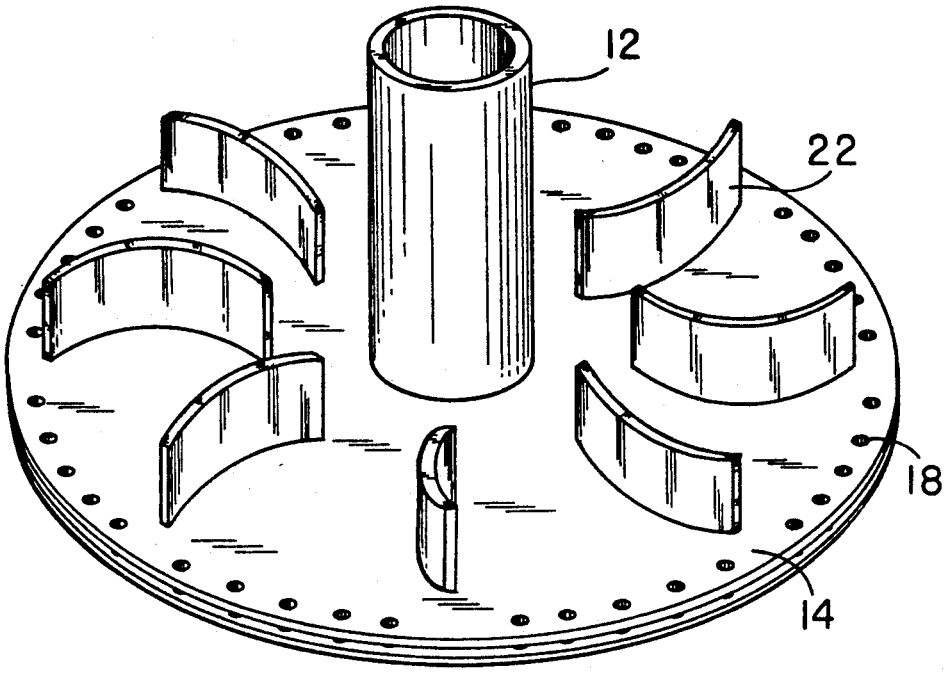
FIG. 3
FIG. 4
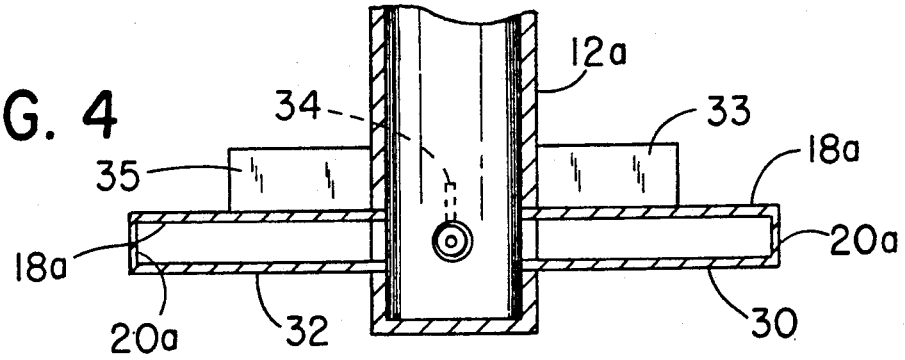
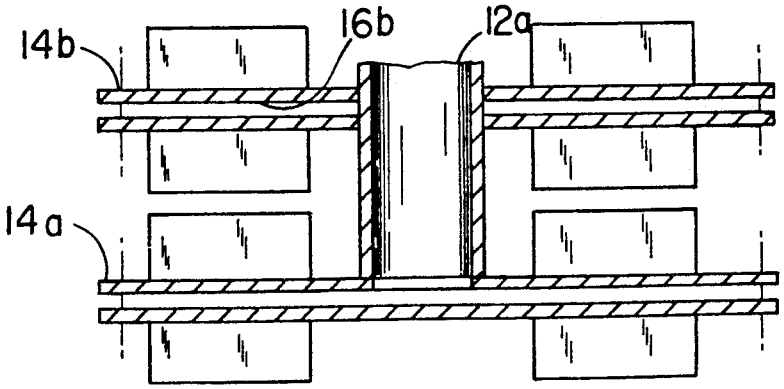
FIG. 5

GAS DISPERSION STIRRER WITH FLOW-INDUCING BLADES

The invention relates to a gas dispersion stirrer comprising a rotatable hollow shaft and at least one hollow stirring member disposed thereon, where its cavity communicates with said hollow shaft and has apertures towards the liquid to be aerated.

Such stirrers are in general already known as hollow stirrers. The stirring members of such hollow stirrers are designed as tubular stirrers or triangular stirrers (see F. Kneule, Rühren, Praxis der Verfahrenstechnik, Vol. 1, Deutsche Gesellschaft für technisches Apparatewesen, Frankfurt/Main, 1986, pp. 76, 77). Tubular stirrers consist of hollow tubular members radially protruding from the rotatable hollow shaft, whereas the triangular stirrer consists of a hollow triangular disk at whose corners corresponding apertures are provided for the discharge of the gas. Such hollow stirrers are self-aerating stirring members, i.e. as a result of the suction caused by the rotation of the stirrer they draw in gas from the space above the liquid and distribute the same in the liquid. They are used in particular in low-viscosity liquids for the case that the throughput of gas effected by them is sufficient for a desired reaction. On the other hand, the gas dispersion does not start until a minimum rotational speed is exceeded. The same is reached when the velocity pressure, which develops in the apertures of the stirrer as a result of the rotational speed of the stirrer, overcomes the hydrostatic pressure. The efficiency of the self-aeration in accordance with this known method is substantially influenced on the one hand by the increasing hydrostatic pressure (filling level), and on the other hand by an increasing viscosity of the liquid. As a result, such gas dispersion stirrers can in general not be used, for instance, in fermenters.

A further possibility of self-aeration consists in increasing the rotational speed of a conventional stirring member such that from the surface of the fluid to be stirred up to the stirring member a spout is formed. Such a spout-type gas dispersion is, however, not applicable in many cases for process engineering reasons. Moreover, the same can also not be realized when high-viscosity liquids are used.

As compared to self-aeration, larger amounts of gas can be dispersed by the principle of forced aeration. In the forced aeration externally compressed gas is supplied to the stirring member in particular from the bottom by means of static gas distributors. As static gas distributors there are usually used open top tubes, single-ring or multi-ring sprinklers or also porous plates. The gas supplied in this way is chiefly dispersed by means of radially acting stirring members. In the process, the gas gets into the suction flow of the stirring member and is dispersed in particular in the turbulent back end flow (wakes) caused by the stirrer blades or stirrer arms.

In the forced aeration, other than in the self-aeration, the throughput of gas can be varied independent of the stirring efficiency or the rotational speed of the stirrer. On the other hand, by means of forced aeration gas can also be dispersed with a higher viscosity of the liquid. What is, however, disadvantageous in the known forced aeration by means of lances or single-ring or multi-ring sprinklers is the wide spectrum of bubbles forming in low-viscosity liquids. This means that the gas bubbles generated have very different diameters. In the area of the back end flow of the stirrer blades, for instance, large bubbles are formed, which escape from the liquid very quickly and thus contribute only little to a possibly desired mass transfer between gas and liquid. On the other hand, due to its very high retention times, the content of fine bubbles formed in higher-viscosity liquids is often very quickly deprived of the component of useful material, which should be transferred, so that for the rest of the retention time it only represents a non-usable dead volume. A further disadvantage of this prior art consists in that with a given rotational speed of the stirring members the supplied stream of gas volume is limited by the so-called flooding point of the stirring member. In the operating state of flooding the stirring member is virtually completely surrounded by gas. An increase of the throughput of gas beyond this flooding point leads to the decrease of the specific interface between the gas and the liquid, and to a totally unfavorable and insufficient flow condition in the stirrer vessel, so that the mass transfer is negatively influenced. As a result, the range of applications of the commonly used gas dispersion stirrers is limited by the flooding point.

In particular to improve the forced aeration of highly-viscous liquids a gas dispersion system was developed recently, where the gas dispersion and the circulation of liquid is performed by different members (F. Kneule, loc. cit., pp. 79–81). In this system, the gas is supplied through a hollow shaft to a rotating ring of nozzles, where capillaries radially disposed thereon ensure that in the shear field of the liquid bubbles with a uniform spectrum of sizes are generated. The circulation and distribution of these bubbles in the reactor volume is effected by conventional stirring members, which are mounted on a second shaft. The essential disadvantage of this arrangement consists in the complex structure, as here two concentrically mounted shafts are required, which in general are driven at two different rotational speeds.

The object of the present invention is to provide a gas dispersion stirrer of the above-described kind, with which on the one hand an effective aeration of liquids is reached and thus an improvement of the mass transfer, and on the other hand a structural design should be ensured which is as simple as possible.

In accordance with the invention this object is solved in that the stirring member comprises at least one flow-inducing blade, and that the apertures are disposed in the vicinity of the discharge flow directed from the inside to the outside. An essential feature of this invention consists in that the gas under excess pressure flows through cavities in said stirring members up to appropriate apertures disposed at the periphery, and is dispersed here in the form of bubbles. What is decisive is that the formation of the bubbles at said apertures, which can preferably be designed as circular bores or as narrow slits, takes place under the influence of the liquid flowing away from the stirring member—i.e. from the inside to the outside, so that smaller bubbles are formed than bubbles formed in a static liquid. Of essential importance furthermore is that said apertures in the stirring member are arranged such that the bubbles formed are moved away from the stirring member with the discharge flow directed from the inside to the outside, and are then distributed on a large scale in the liquid volume to be aerated. To ensure this, the apertures must be disposed outside the blades additionally provided in accordance with the invention, i.e. outside the stirrer blades or stirrer shovels. With this arrangement it is avoided in accordance with the invention that the formed bubbles can get in the area of partial vacuum behind the blades, causing there the undesired gas pads, in particular in the case of highly viscous media. Since the formed bubbles are immediately moved away from the stirrer, it is avoided that—as in the conventional gas dispersion—in the case of a high throughput of gas the stirring member is surrounded with gas to such an extent that the stirring member is flooded. The risk of flooding only occurs, if it occurs at all, with a substantially higher throughput of gas than in the case of a conventional gas dispersion, as only a part of the entire dispersed gas gets in the vicinity of the stirring member with the circulation and suction flow, and accordingly less gas can accumulate in the areas of partial vacuum behind the blades of the stirring member.

The gas can be introduced in the liquid by forced aeration on the one hand, and on the other hand also by self-aeration with the gas dispersion stirrer in accordance with the invention.

By means of the inventive gas dispersion stirrer the flooding point is moved towards a higher throughput of gas with the same rotational speed of the stirrer, i.e. considerably more gas can be dispersed in the reactor volume than in the case of conventional, for instance radially acting stirring members. Due to the fact that the bubbles are generated under the influence of the radial or tangential shear field of the liquid flowing away from the stirring member, there are formed both smaller bubbles and bubbles varying less in diameter. As a result of the increased specific interface there is obtained a considerable increase of the mass transfer between the dispersely distributed gas phase and the liquid. A marked improvement of the so-called volumetric transport coefficient $k_l \cdot a$, which is a measure for the intensity of the mass transfer, can be achieved with the novel method as compared to the conventional gas dispersion methods, in particular in the case of higher-viscosity Newtonian liquids, and last but not least higher-viscosity, structurally viscous non-Newtonian liquids. This can also be achieved for the aeration of non-coalescing liquids, in which the smaller primary bubbles generated by means of the novel method remain dispersed substantially stable, and for the mass transfer there is then available a correspondingly large exchange area.

In accordance with an expedient embodiment the gas discharge apertures are provided on the outer radius of a circular disk on the upper side and/or on the lower side in the required size (e.g. diameter of the bore). The gas is passed through the hollow shaft and through appropriate cavities in said disk to said apertures. On its upper side and/or on its lower side the disk can be provided with straight or curved blades extending in radial direction. Accordingly, said stirring member is similar to a Rushton turbine. However, in the gas dispersion stirrer in accordance with the invention the blades should not extend up to the radius of the circular disks, on which said apertures (bores or slits) are disposed. Due to this arrangement of the bores the shearing effect of the interfacial flow between the blades, which is directed from the inside to the outside, and of the circulating flow, which is generated by the stirring member both from the top and from the bottom, is utilized optimally for generating small bubbles and thus for creating larger interfaces between gas and liquid. In addition, in accordance with a further embodiment of the invention the front side of the disk is additionally provided with bores, so that even more gas can be dispersed if necessary. These bubbles formed on the front side are also subject to a shearing effect, which is exerted by the tangential shear field between the rotating stirring member and the liquid caused to rotate. From a constructive point of view, the gas dispersion stirrer has the advantage that only one hollow shaft is required. If necessary, a plurality of gas dispersion members of the described kind can be mounted on said hollow shaft, when this is necessary, for instance, in slender stirring reactors to maintain an even and thoroughly mixed liquid volume.

It is furthermore advantageous that the geometrical shape of previously known and commonly used gas dispersion stirrers can substantially be maintained, and in so far well-tried design elements are included in the structural embodiment of the novel gas dispersion systems.

Further details and advantages of the present invention can be taken from the subsequent discussion of the embodiments explained by means of FIGS. 1 to 3, wherein FIG. 1 shows a perspective view of a partially represented gas dispersion stirrer with straight blades in accordance with a first embodiment of the present invention;

FIG. 3 shows a perspective view of a further embodiment of the gas dispersion stirrer having curved blades in accordance with the invention FIG. 4 shows a section through still another embodiment of a gas dispersion stirrer having short tubular members in accordance with the invention.

Figure 1:
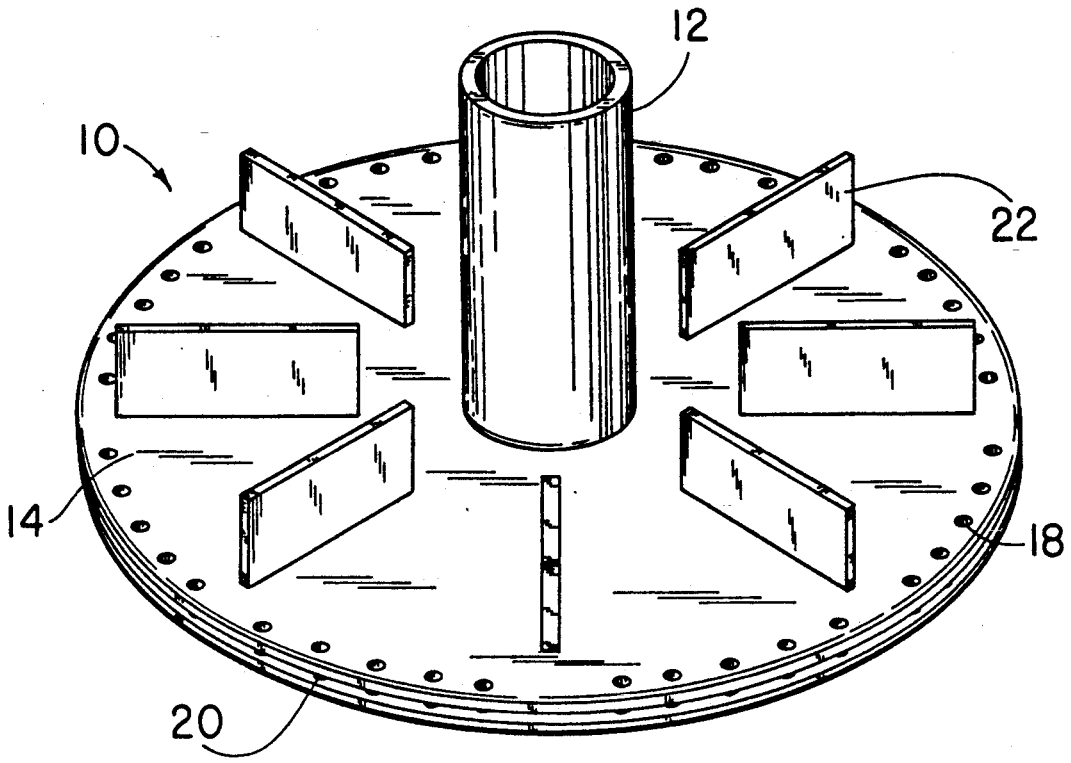
Figure 2:
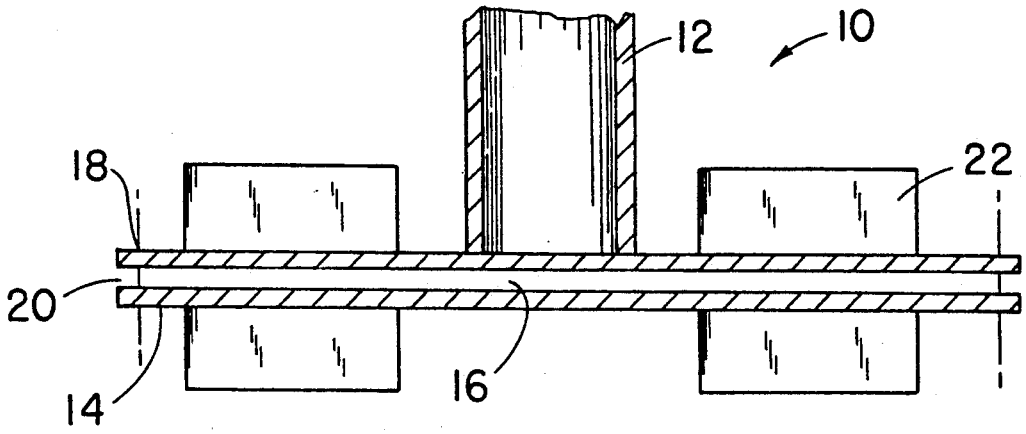
FIG. 2 shows a section through the gas dispersion stirrer in accordance with the embodiment represented in FIG. 1

FIGS. 1 and 2 show a first embodiment of the gas dispersion stirrer 10 in accordance with the invention. To a hollow shaft 12 shown here in section a stirring member 14 is connected centrically. Said stirring member 14 substantially consists of a disk with a corresponding cavity 16, which communicates with said hollow shaft 12. On the disk eight blades 22 are disposed radially, and in these embodiments, as can be taken from FIG. 2, said blades 22 are disposed on both sides of said disk. On the outer radius of the circular hollow disk 14, on the upper and lower side of said disk, corresponding apertures 18 designed as bores are disposed, through which the gas, which flows into the hollow shaft along the direction of the arrow in accordance with FIG. 2 and flows on through said hollow disk, is delivered to the liquid.

It is important that the blades 22 do not protrude into the outer radius of the disk 14, in which the apertures 18 are disposed. In this way it is ensured that the fluid flow, which is displaced by the blades 22 and flows to the outside radially along the disk, shears off the bubbles directly at the apertures 18 and takes them to the outside in discharge direction.

In accordance with the embodiment discussed here, on the outer rim of said hollow disk there are also provided apertures 20. Here, the bubbles are sheared off due to the tangential flow component of the fluid flow surrounding the stirring member 14.

A variation of the stirring member discussed above is represented in FIG. 3. The same substantially differs in that instead of the straight blades 22 it has curved blades 22, as they are shown in FIG. 3.

The shapes of stirring members represented here only constitute advantageous embodiments within the scope of the inventive idea. Another embodiment can, as shown in FIG. 4, consist in that similar to the hollow stirrer, short tubular members 30, 31, 32 radially protruding from said hollow shaft 12A are provided with apertures 18A and 20A and on which in the inner portion corresponding blade 33, 34 and 35 are welded upright or also with an inclination, the ends of said short tubular members extending beyond the same. When the blades are arranged in the upright position, there is obtained a blade stirrer modified in accordance with the present invention. When the blades are attached with an inclination, there is obtained an inclined-blade stirrer modified in accordance with the invention. As shown in FIG. 5, moreover, a plurality of gas dispersion members 14A, 14B of the described kind are mounted on the hollow shaft 12A. The gas dispersion members 14A and 14B are similar to that shown and described in connection with FIGS. 1 and 2. With respect to dispersion member 14B, moreover, cavity 16B in the member 14B is in communication with the hollow shaft 12A.

We claim:

1. A gas dispersion and liquid stirrer comprising a rotatable hollow shaft and at least one circular stirring member disposed thereon having a cavity formed therein that communicates with said hollow shaft, said stirring member being provided with apertures, said apertures being oriented towards a discharge of the fluid to be aerated, and at least one solid flow-inducing blade for radially directing the liquid flow from said shaft towards said apertures formed on said stirring member, said stirring member being a hollow disk having an outer radius in which said apertures are disposed, said at least one slow-inducing blade having a plurality of flow-inducing blades formed on said disk and each blade being arranged at a right angle to said disk, the flow-inducing blades extending radially outwardly on said hollow disk for a distance less than the outer radial distance of said hollow disk in which said apertures are disposed.

2. The gas dispersion stirrer according to claim 1, characterized in that said blades are disposed on an upper surface and a lower surface of said hollow disk.

3. The gas dispersion stirrer according to claim 2, characterized in that said blades are straight in a radial direction relative to the center of said hollow disk.

4. The gas dispersion stirrer according to claim 2, characterized in that said blades are curved.

5. The gas dispersion stirrer according to claim 2, characterized in that said apertures constitute circular holes or narrow slits.

6. The gas dispersion stirrer according to claim 2, characterized in that said at least one circular stirring member comprises a plurality of circular stirring members, each stirring member having respective cavities formed therein and each stirring member being disposed on said hollow shaft said cavities each communicating with said hollow shaft.

7. The gas dispersion stirrer according to claim 1 characterized in that said blades are straight in a radial direction relative to the center of said hollow disk.

8. The gas dispersion stirrer according to claim 7, characterized in that said apertures constitute circular holes or narrow slits.

9. The gas dispersion stirrer according to claim 7, characterized in that said at least one circular stirring member comprises a plurality of circular stirring members, each stirring member having respective cavities formed therein and each stirring member being disposed on said hollow shaft said cavities each communicating with said hollow shaft.

10. The gas dispersion stirrer according to claim 1 characterized in that said blades are curved.

11. The gas dispersion stirrer according to claim 10, characterized in that said apertures constitute circular holes or narrow slits.

12. The gas dispersion stirrer according to claim 10, characterized in that said at least one circular stirring member comprises a plurality of circular stirring members, each stirring member having respective cavities formed therein and each stirring member being disposed on said hollow shaft said cavities each communicating with said hollow shaft.

13. The gas dispersion stirrer according to claim 1, characterized in that said apertures constitute circular holes or narrow slits.

14. The gas dispersion stirrer according to claim 13, characterized in that said at least one circular stirring member comprises a plurality of circular stirring members, each stirring member having respective cavities formed therein and each stirring member being disposed on said hollow shaft said cavities each communicating with said hollow shaft.

15. The gas dispersion stirrer according to claim 1, characterized in that said at least one circular stirring member comprises a plurality of circular stirring members which each protrude in a radial direction from said hollow shaft, said stirring members each having respective cavities formed therein that communicate respectively with said hollow shaft, each of said stirring members being provided with apertures, said apertures being oriented towards a discharge of the fluid to be aerated.

16. The gas dispersion stirrer according to claim 1, characterized in that said at least one circular stirring member comprises a plurality of circular members, each stirring member having respective cavities formed therein and each stirring member being disposed on said hollow shaft, said cavities each communicating with said hollow shaft.

* * * * *